US005704758A

United States Patent [19]

Davis et al.

[11] Patent Number: 5,704,758

[45] Date of Patent: Jan. 6, 1998

[54] ARTICLE PLACING ASSEMBLY AND PROCESS

[75] Inventors: John R. Davis, Deerwood; Larry A. Rasmussen, Crosslake, both of Minn.

[73] Assignee: Riverwood International Corporation, Atlanta, Ga.

[21] Appl. No.: 686,810

[22] Filed: Jul. 26, 1996

[51] Int. Cl.[6] ..... B65G 59/00

[52] U.S. Cl. ..... 414/798.9; 414/797.9; 414/786; 271/104; 271/167; 271/169

[58] Field of Search ..... 414/797.9, 798.1, 414/798.5, 798.9, 786; 271/104, 105, 131, 165, 167, 169; 221/251; 493/316, 364, 478

[56] References Cited

U.S. PATENT DOCUMENTS

| | | | |
|---|---|---|---|
| 2,022,242 | 11/1935 | Kristof | 214/1 |
| 3,259,384 | 7/1966 | Hittenberger | 271/62 |
| 3,527,367 | 9/1970 | Bivans | 414/798.9 |
| 3,876,489 | 4/1975 | Chenel | 156/566 |
| 4,042,126 | 8/1977 | Blauvelt et al. | 414/798.9 |
| 4,516,765 | 5/1985 | Stocco et al. | 271/95 |
| 4,566,846 | 1/1986 | Cartwright | 414/798.9 |
| 4,881,934 | 11/1989 | Harston et al. | 493/315 |
| 5,019,207 | 5/1991 | McCoy | 414/798.9 |
| 5,082,268 | 1/1992 | Santoro | 414/797.9 |
| 5,161,791 | 11/1992 | Akiyama et al. | 271/12 |
| 5,171,007 | 12/1992 | Kasprzak et al. | 271/167 |
| 5,180,377 | 1/1993 | Wakabayashi et al. | 493/316 |
| 5,484,377 | 1/1996 | Ueda et al. | 493/316 |
| 5,547,336 | 8/1996 | Whiteman | 414/798.9 |

FOREIGN PATENT DOCUMENTS

| | | | |
|---|---|---|---|
| 2198711 | 6/1988 | United Kingdom | 414/798.9 |

*Primary Examiner*—Karen B. Merritt
*Assistant Examiner*—Douglas Hess
*Attorney, Agent, or Firm*—Anthony G. Eggink

[57] ABSTRACT

An article placing assembly having a pushing mechanism constructed and arranged to engage and move articles from an article stack. The assembly has opposing pivoting gate members which cooperate to hold and release successive articles. Movable clamps further cooperate to hold the article stack as successive articles are sequentially moved from the article stack. A process is set forth for separating and removing successive articles from an article stack in a magazine.

20 Claims, 7 Drawing Sheets

ARTICLE PLACING ASSEMBLY AND PROCESS

BACKGROUND OF THE INVENTION

This invention relates generally to a magazine assembly and process for releasably storing articles for subsequent transfer. Particularly, this invention relates to a magazine release assembly to position and release fragile articles to an article transfer mechanism from the pickup end of a storage magazine.

Although storage magazines are utilized in various manufacturing and assembling processes, such magazines are not typically utilized to store and release fragile or breakable articles, such as plates of glass. Generally, magazine assemblies are gravity fed or powered and are constructed to maintain a stack of articles therein and are used to ensure that a constant supply of articles is available at the pickup end of the magazine. These magazine assemblies are typically used in conjunction with article pickup mechanisms to transport successive articles from the stack of articles in the magazine to a predetermined location for subsequent use. For example, pickup mechanisms may comprise vacuum cups extending from an article transport assembly which successively engage and transfer the first-out article in the magazine therefrom and onto a conveyor structure.

Article storage magazines are typically provided with retention structures which maintain the stack of articles in the magazine and which permit the articles to be individually and successively removed from the stack. The retention structures are typically stationary members mounted at the magazine exit end and which require the articles to be flexed for passage thereby and, therefore, are not suited for the retention of brittle articles, such as glass.

In summary, prior art magazine structures typically comprise an inclined base on which a stack of articles is held by rigid retention clips to permit the removal of successive articles. The individual articles are typically engaged and pulled past the retention clips whereby each article or portions thereof are flexed or bent during the removal process. Such removal, however, is limited to flexible articles and not suited for rigid and brittle articles, such as glass pieces. For example, glass pieces and other heavy, rigid articles may break or be subject to damage when pulled through a rigid retention structure of a magazine. If the retention structures are modified to be flexible members to thereby reduce the possibility of article damage, the retention system may lack the physical strength required to hold back a gravity-fed stack of articles, such as plate glass, and may cause the stack to fall through the exit end of the magazine. Such lack of hold back force is particularly likely when a stack of articles is positioned at an angle for gravity-feed purposes.

The magazine release assembly of the present invention provides a means to overcome the problems and difficulties of prior art article supply retention and release systems. And as far as is known, such a magazine release assembly for use with rigid and fragile articles, such as glass pieces, has not been utilized or proposed in the art.

It is an objection of the present invention to provide a magazine release assembly for use in storing and feeding articles which are heavy and fragile in composition. Particularly, it is an object of this invention to provide a magazine release assembly which physically engages and moves the first-out article from a stack of articles for pickup and transfer. A further object is to provide a magazine assembly which moves successive articles from a gravity-fed stack and vertically positions the next-out article for removal from a stack of articles in a supply magazine so as to maintain the integrity of the remaining article stack in the magazine.

SUMMARY OF THE INVENTION

The present invention relates to a magazine assembly and process for releasably storing articles for sequential transfer. The assembly includes an article positioning and release assembly at the exit end of the article supply magazine. The magazine assembly and process position and release fragile articles, such as plates of glass, from the pickup end of the article storage magazine. The assemblies are constructed and arranged to cooperate with an article transfer assembly to successively move articles from the storage magazine to a predetermined location, for example, onto a conveyor.

The article positioning and release assembly or article placing assembly comprises a pushing mechanism constructed and arranged to engage and move successive articles from an article stack in a supply magazine. The assembly has opposing pivoting gate members, opposing clip members and at least one pair of moveable clamps which are located at the exit end of the article storage magazine. The pushing mechanism, pivoting gate members, clip members and moveable clamps cooperate to separate and present sequential articles from an article stack in the article storage magazine.

The article placing assembly is constructed and arranged at the periphery of the exit end of a supply magazine and which provides the interface between the magazine deck and an article transfer assembly. The invention includes a magazine structure having a configuration which supports a sliding stack of glass plates to the article positioning and release assembly.

These and other benefits of this invention will become clear from the following description by reference to the drawings.

DESCRIPTION OF THE PREFERRED EMBODIMENTS

The article placing assembly and process of the present invention relate generally to the positioning and release of articles from an article stack in a storage magazine. The assembly and process may be utilized at work stations which form a part of an article assembling apparatus. The article placing assembly is particularly shown in FIGS. 4–8 of the drawings.

Figures 1, 1A, 1B:
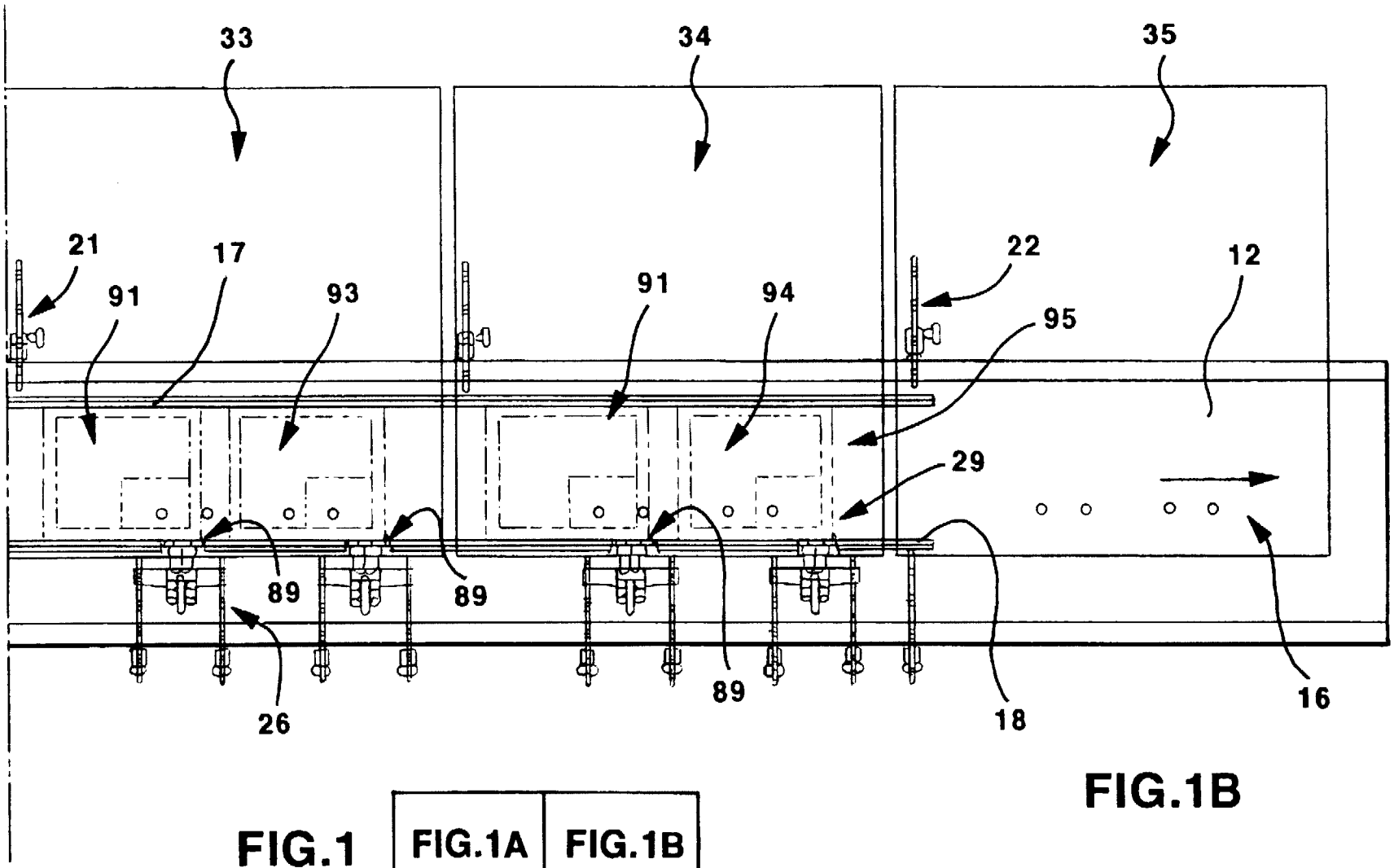
FIG. 1 is a top plan view showing a frame assembling apparatus and the glass placing assembly of the present invention.
Figure 1A:
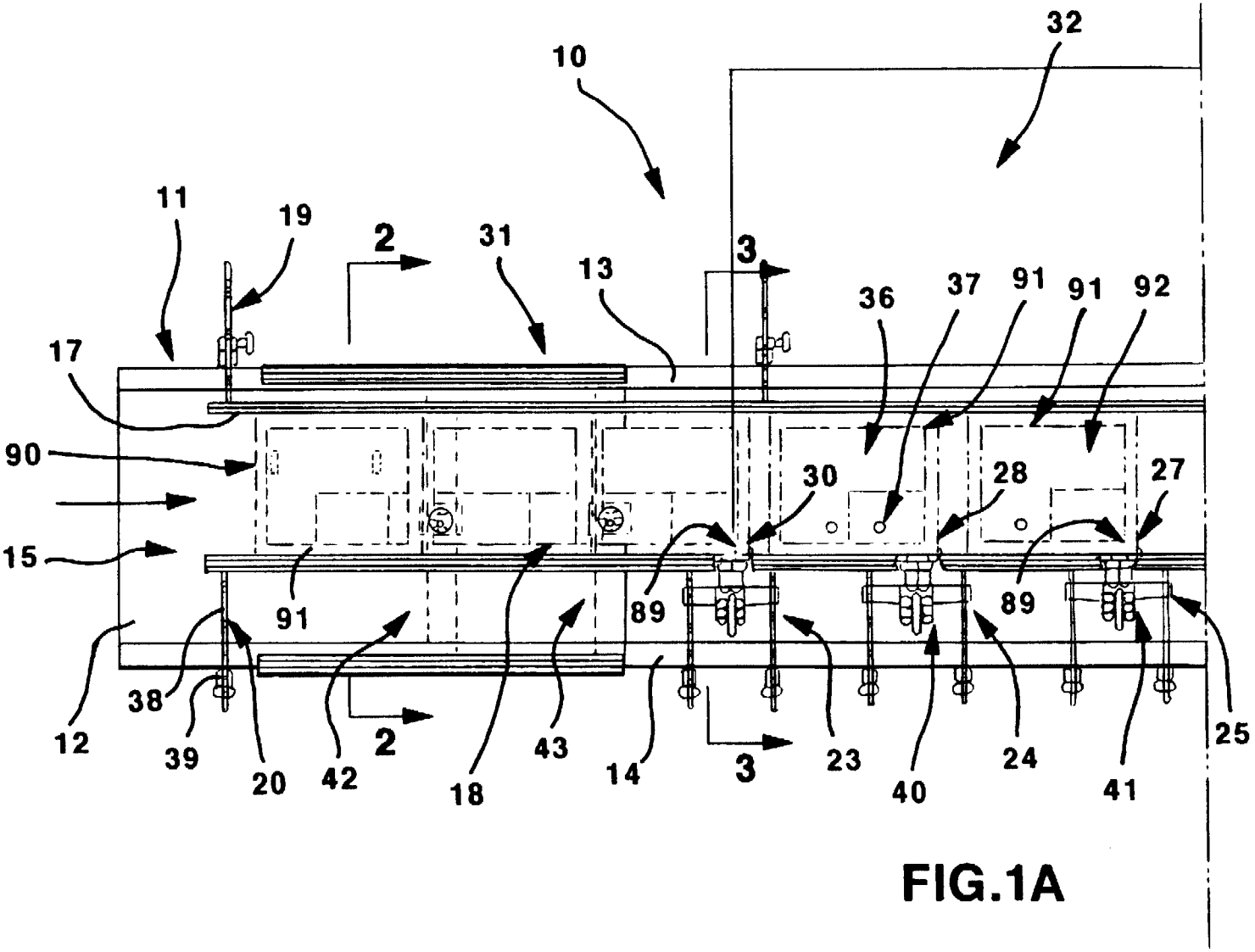
Figure 2:
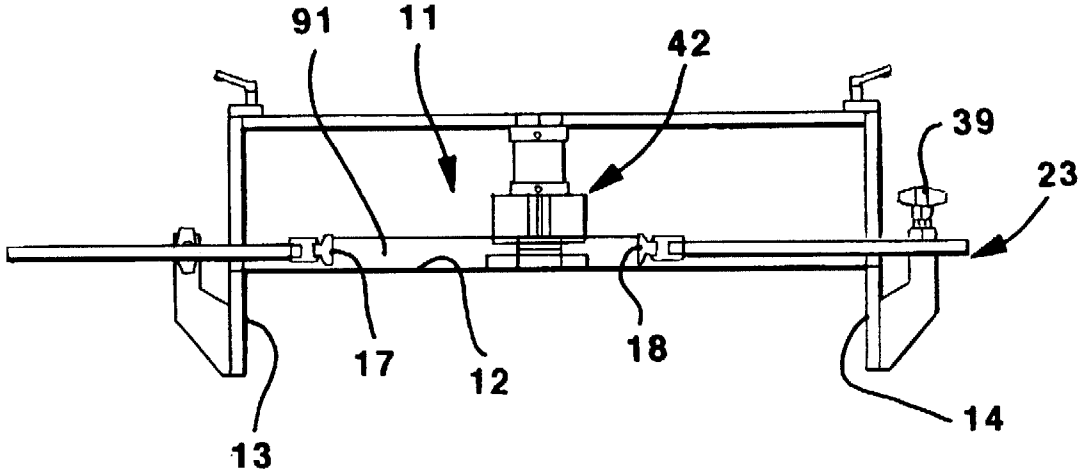
FIG. 2 is a view taken along line 2—2 of FIG. 1.
Figure 3:
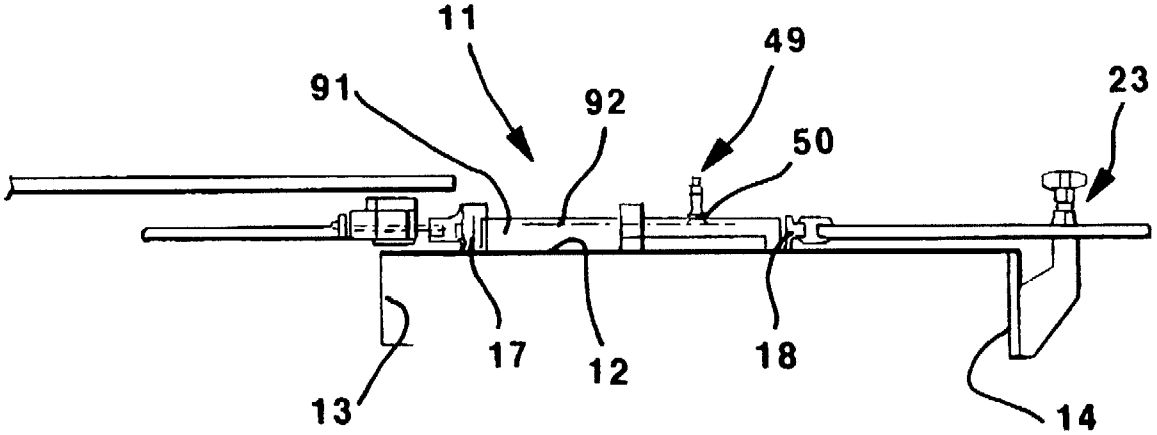
FIG. 3 is a view taken along line 3—3 of FIG. 1.

The embodiments of the invention are shown and described in cooperation with respect to the assembly of frames, such as picture frames, wherein a plurality of articles are sequentially stacked onto each other to form a stream of assembled frames on a conveying surface. FIGS. 1–3 show an assembling apparatus 10 utilized to stack and assemble articles on a conveyor having a moving work surface. A plurality of work stations are provided wherein first articles, i.e., inverted frames 91, are spaced at work station 31 and wherein second, third and fourth articles are placed or stacked onto the first article at work stations 32, 33, and 34, respectively. The number of work stations and the structure of the assembling apparatus may vary with respect to the article placing assembly and process of the present invention. For example, the article placing assembly may be utilized at work station 32 to provide glass plates for transfer to the inverted frames 91 on conveyor 11.

Referring to FIG. 1, an assembling apparatus 10 is shown wherein a stream of inverted frames 90 is supplied at one end and wherein a plurality of articles are sequentially stacked and transported to form a stream of assembled frames 95 at the opposite end. The assembling apparatus 10 is shown to sequentially move inverted frames 91 on a conveyor or moving work surface 11 from a setup work station 31 sequentially through work stations 32, 33 and 34, respectively, where articles, such as plates of glass, sales sheets and backing boards are placed into the confines of the inverted times 91 at the respective work stations.

As shown, the assembling apparatus 10 has a conveyor structure 11 comprised of a continuously moving endless belt 12 disposed between frame rails 13 and 14. The conveyor 11 extends from a first end 15 to a second end 16 of the assembly apparatus 10. The continuously moving belt 12 transports the inverted times 91 during assembly from the setup station 31 through work stations 32, 33 and 34. Positioned above the endless belt 12 are parallel line guides 17 and 18 between which the inverted frames 91 are moved. The line guides 17 and 18 are shown to be supported by means of a plurality of support structures 19–26 which are connected to the opposing frame rails 13 and 14. For example, support structures 19, 21 and 22 connect frame rail 13 to line guide 17 and adjustable support structures 20, 23, 24, 25 and 26 connect frame rail 14 to line guide 18. Further, support structures 24 and 25, for example, show a pair of support structures which are positioned at work station 32.

Although the endless belt 12 continuously moves, a plurality of line stop mechanisms, i.e., 27, 28, 29 and 30, are shown and which are used to momentarily stop the inverted times 91 at predetermined locations between first end 15 and second end 16. The stop mechanisms 27, 28, 29 and 30 are controlled and activated by sensing assemblies, i.e., photoeyes, for example, and the stop mechanisms temporarily immobilize the frames 91 between the opposing line guide rails 17 and 18. The various articles or parts used to assemble the picture frames, i.e., glass plates 92 at work station 32, sales sheets 93 at station 33 and backing boards 94 at station 34 are sequentially placed and stacked into the frames to thereby assemble the frame product.

As shown in FIG. 1, the conveyor 11 provides a moving work surface within reach of the work stations 32, 33, 34 and 35. A work area 36 is shown between line guides 17 and 18 and which represents the area in which an inverted frame 91 is positioned for receiving a first article at station 32. The line guides 17 and 18 are adjustable to accommodate frames of various dimensions. Work area 37 having dimensions smaller than work area 36, is shown to represent the area in which a smaller inverted frame 91, for example, is positioned for receiving a first article at station 32. Further, adjustable support structure 20 of line guide 18 is shown to have an arm member 38 and a release and lock assembly 39 to permit the adjustability of the line 18 to thereby accommodate the work area dimensions, such as areas 36 and 37. The adjustable support structures 23, 24 and 25 are similarly constructed.

FIG. 1 further shows that two inverted frames 91 are simultaneously processed at each work station, i.e., two plates of glass 92 placed on two adjacent inverted frames 91. The number of frames processed, however, may be one, two or more at each work station. Although the assembling apparatus 10 is described with respect to the assembly of picture frames 91, it is likewise within the purview of this invention to place or stack other articles on a moving object at the respective work stations 32, 33, 34 and 35, such as stacking components used in the assembly of circuit boards, for example.

Referring to FIGS. 1–4, a set up station 31 is initially utilized to momentarily stop the frames 91 for spacing and timing purposes. Line stop 30 is shown operative through line guide 18 for such purpose. Sensing and stop assemblies 42 and 43, which include photo eyes, for example, are utilized in conjunction with adjustable stop members and which cooperate with line stop 30 to effect the release of spaced inverted frames 91. For example, activatable members engage frames 91 from above at a predetermined location of the frame structure. The frames 91 are released for transfer to work station 32 where line stops 27 and 28 temporarily immobilize the frames 91 with respect to line guides 17 and 18 to permit the transfer of a first article, such as glass plates 92 from magazine assembly 46 via an article placer assembly 48 and into the inverted frames 91. The frame 91 movement on conveyor 11 is repeated to work station 33 and subsequently to work station 34 where second and third articles, such as sales sheets 93 and backing boards 94, respectively, are placed and stacked into inverted frames 91 via article placer structures, as will be further described with respect to FIG. 4. The line stop mechanisms 27–30 are all synchronized and operated by sensing assemblies, i.e., photo eyes, which when activating the associated line stops cause the article placer assemblies to transfer and stack the respective articles at the respective work stations onto the frames 91 on the conveyor 11. For example, activation assemblies 40 and 41 are shown mounted at support structures 24 and 25, respectively, to operate line stops 28 and 27, respectively. Activation assemblies 40 and 41 may be pneumatically operated, however, other operating means known in the art may also be utilized to effect the momentary stoppage of the inverted frames at the respective work stations.

The operation of the article placer assemblies at work stations 32, 33 and 34 and the line stops, i.e., 27–30 for the frames 91 are all synchronized and controlled by a computerized line control system which includes software that processes signals from various sensing means used in the assembling apparatus 10. Thus, for example, the respective line stops will only activate when the presence of frames 91 are detected and the placer assemblies, i.e., placer 48 at station 32, will only transfer articles or parts when frames 91 are immobilized and positioned at the respective work station between the line guides 17 and 18.

Referring to FIGS. 4–7, an article placing assembly 45 is shown positioned on an adjustable stand 44 at work station 32. The placing assembly 45 is shown to have a magazine assembly 46 with an article release mechanism 52 positioned at its exit end. As shown, this embodiment of the article supply magazine assembly 46 provides a stack of glass plates 47 for pickup and transfer by the article transfer assembly 48 to the work area on conveyor 11. The article or glass placing assembly 45 removes the first out plate of glass 88 from the glass stack 47 and moves it upwardly to position the glass plate 88 for pickup and transfer by the article transfer assembly 48. The glass placing assembly 45 positively controls each plate of glass by sliding it upwardly from the glass supply stack 47 and sequentially positions each glass plate for pickup and transfer by the article transfer mechanism 49 of the article transfer assembly 48. The article transfer mechanism 49 is shown to have a vacuum stem 51 and vacuum cup 50.

The magazine assembly 46 is mounted to and extends above base plate 54. Article guides 55 are provided to direct the article stack for movement on magazine deck 53 to the exit end of the magazine. As further shown, an air cylinder 62 is provided to operate the reciprocating placer assembly 48. For safety purposes, an exterior guard structure 56 having hinged doors with handles 57 are provided to cover the operating areas of the assembling apparatus 10.

Importantly, the article release mechanism 52 of magazine assembly 46 is comprised of synchronized and cooperating elements which include a vertical pushing mechanism 61, opposing pivoting side gate members 66 and 67 and activatable upper and lower side clamps 68 and 70 and 69 and 71, respectively. The clamp members 68 and 70 and 69 and 71 cooperate and function sequentially to position the first out glass plate 88 for removal from the glass stack 47 in the magazine 46. The vertical pusher 61 is shown to include a mount 58, a powered slide 59 and plate 60.

Figure 5A:
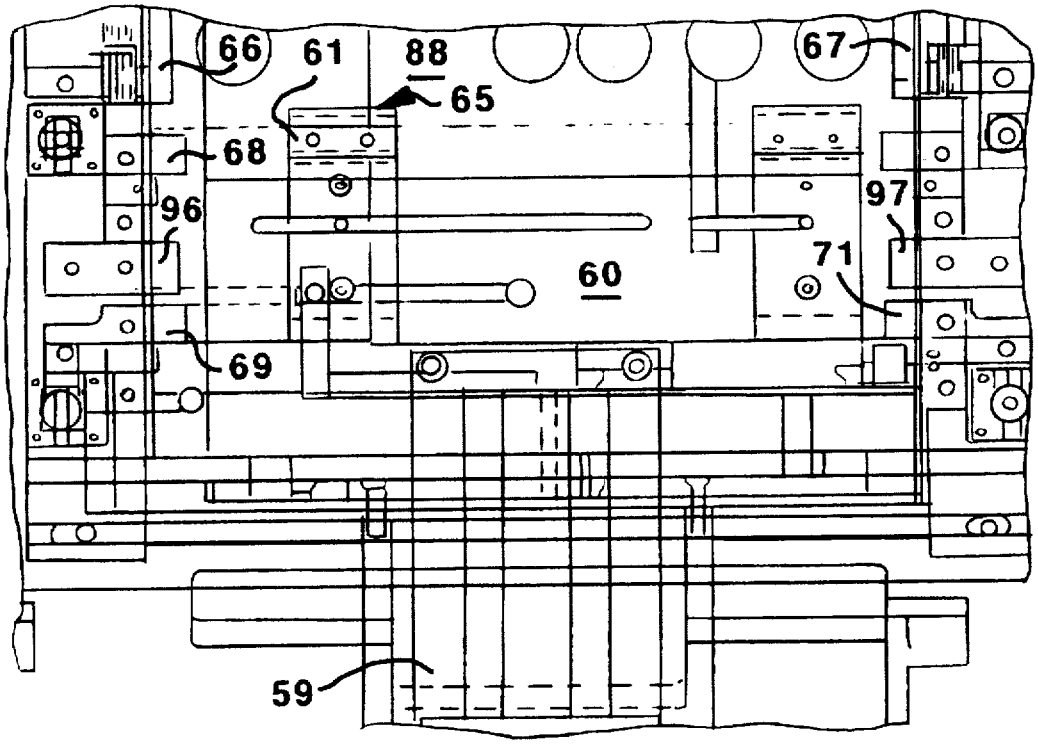
FIG. 5*a* is an enlarged view of a portion of FIG. 5 and particularly showing the article release mechanism of the invention.
Figure 5:
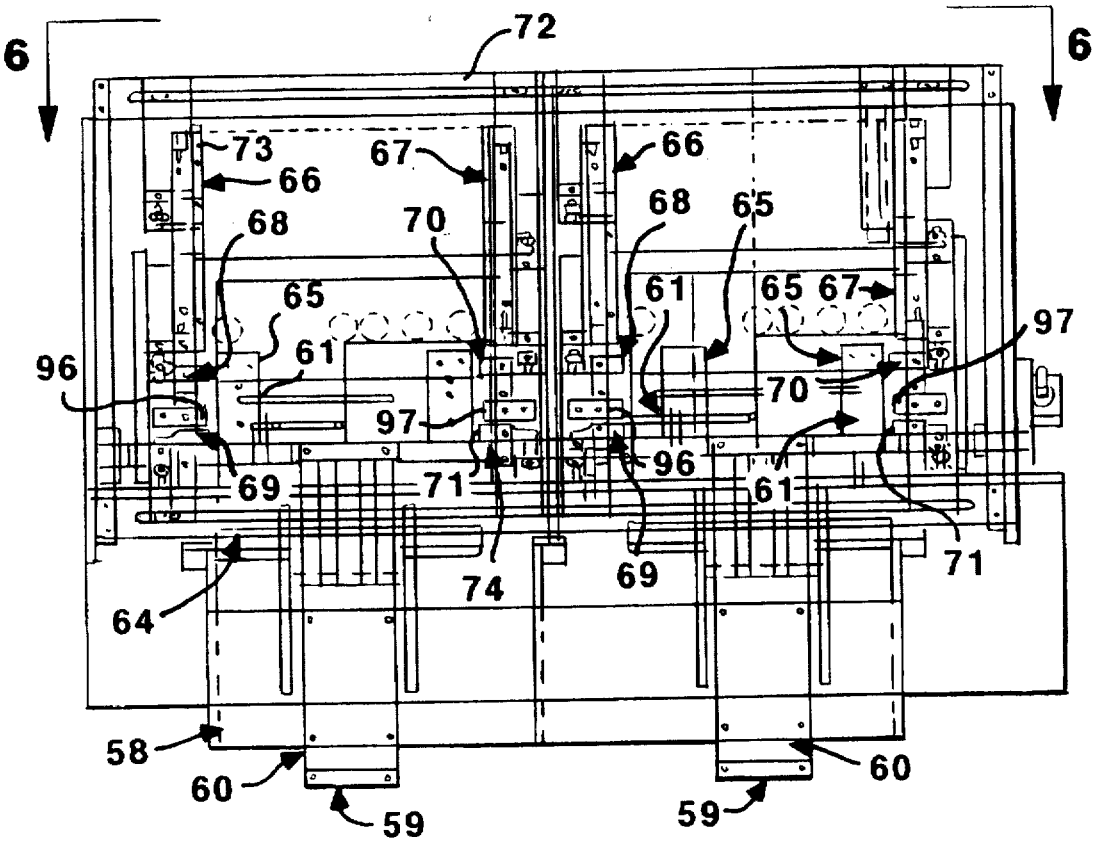
FIG. 5 is a view taken along line 5—5 of FIG. 4.
Figure 6:
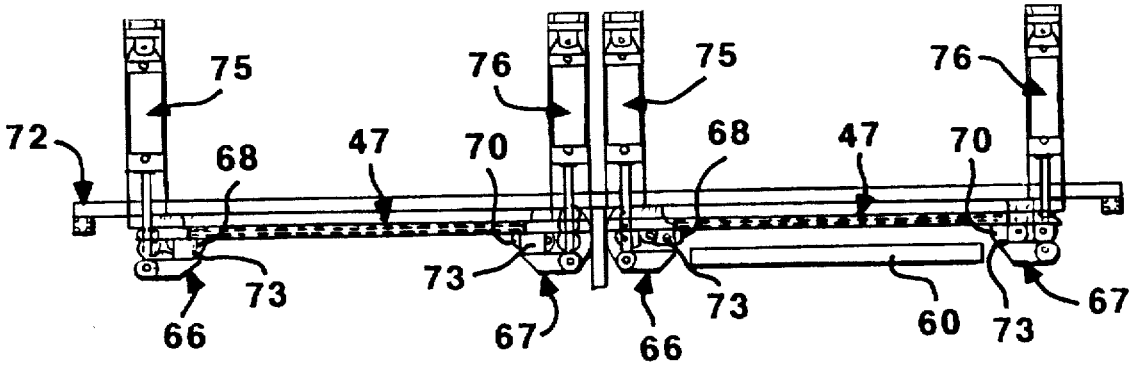
FIG. 6 is a view taken along line 6—6 of FIG. 5.
Figure 7:
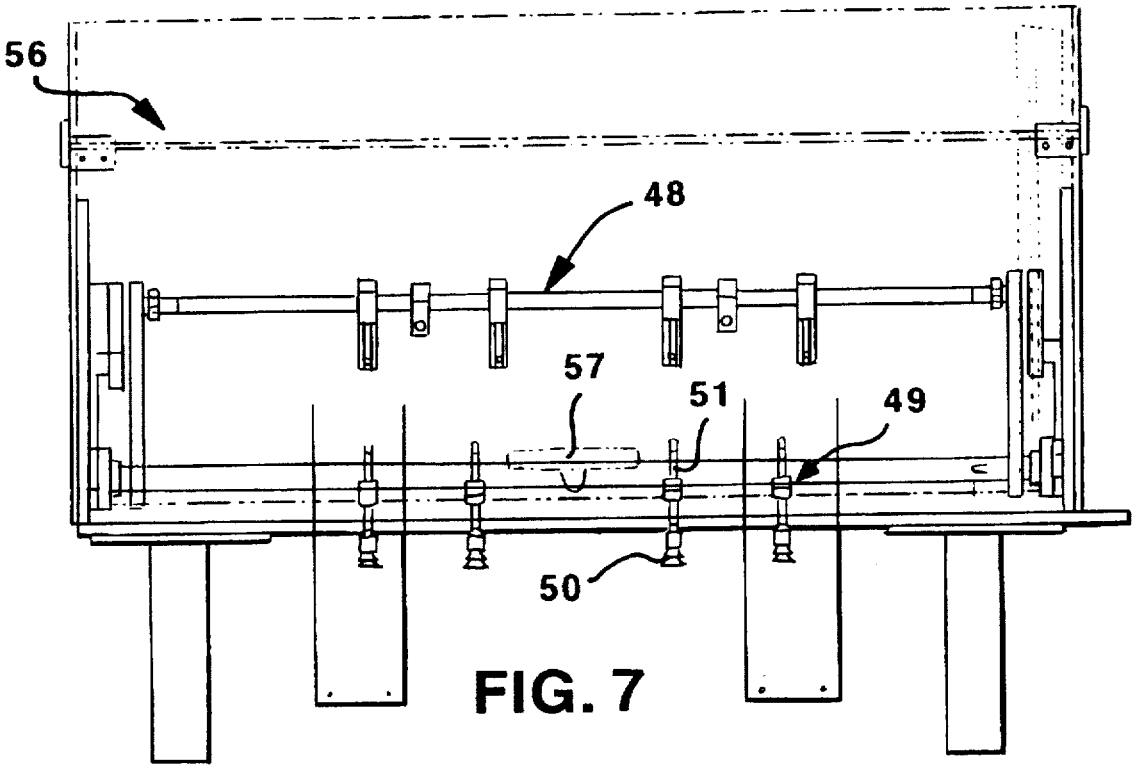
FIG. 7 is a view taken along line 7—7 of FIG. 4.

As shown in FIG. 5, a stationary side clip 96 is positioned and aligned between movable upper and lower clamps 68 and 69 at one side of the magazine exit end and a stationary side clip 97 is positioned and aligned between the movable upper and lower clamps 70 and 71 at the opposite side of the magazine exit end. The alignment of the clamps is particularly shown in FIG. 5(*a*). FIG. 6 shows a top view of the release mechanism and shows the pivotable gates 66 and 67. Each pivotable gate has a pad member 73, constructed of hardened tool steel, for example, which engage the plates of glass during operation. As further shown, the vertical pusher plate 60 is adjustable in width to accommodate different article sizes. The pusher head insert 65 structure may be constructed of a hardened tool steel or the like.

Figure 4:
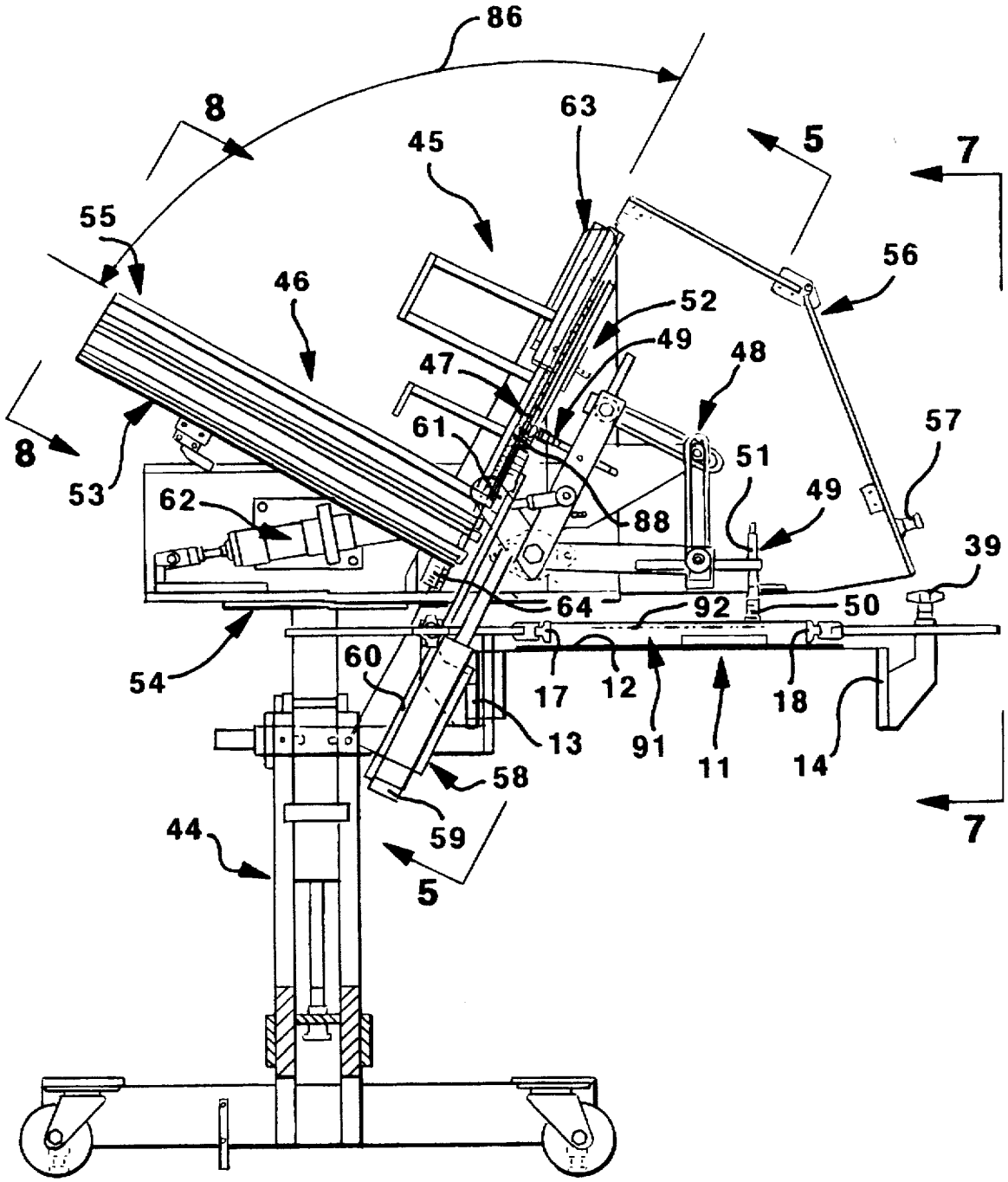
FIG. 4 is a side plan view showing the glass placing assembly of the present invention.
Figure 4A:
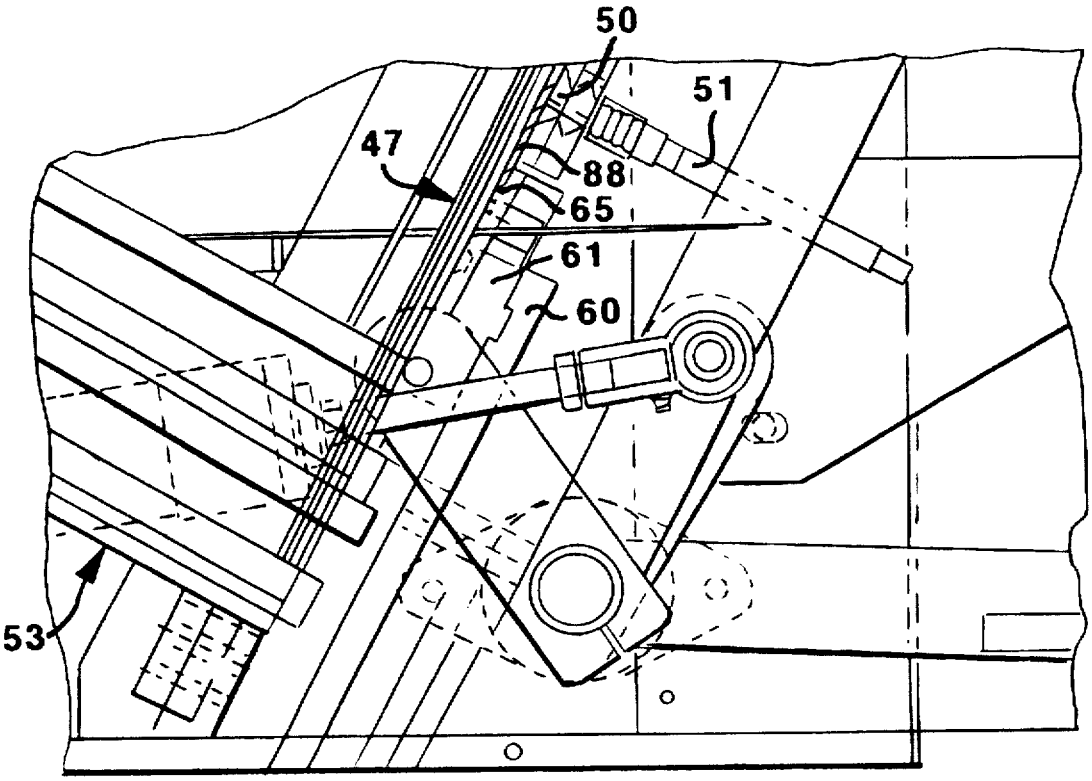
FIG. 4*a* is an enlarged view of a portion of FIG. 4 and particularly showing the pusher assembly of the invention.

Referring specifically to FIGS. 4–6, the magazine is shown to have a lower cross bar 64 and an upper cross bar 72. Further, pivotable gates 66 and 67 are shown to be operated by air cylinders 75 and 76, respectively. The upper and lower clamp members are similarly operated as shown in FIG. 5(*a*). However, as known in the art, the gates and clamps may be controlled by other means, i.e., mechanically, electrically, etc. The article release mechanism 52 has a sequence of operating steps to move and position the next-out glass plate 88 with respect to the glass plate stack 47. The positioning of the next-out glass plate 88 permits the vacuum cups 50 of the article transfer mechanism 49 to engage and grasp successive glass plates from the magazine exit end for transfer. The sequence of the operating steps of the article release mechanism 52 will be described as the vertical pushing mechanism 61 is at its bottom or lower position of travel. When the vertical pushing mechanism 61 is at its lowest position, the glass plate stack 47 is held back or retained by the opposing fixed side clips 96 and 97 and the pivotable side gate members 66 and 67 which are in a closed position. The pusher head insert structure 65 having a pushing ledge engages the bottom of the next-out glass plate 88 and the pushing mechanism 61 moves the glass plate 88 upwardly with respect to the fixed side clips 96 and 97 and behind the closed pivotable side gate members 66 and 67. As this upward movement takes place, the lower hold back clamps 69 and 71 and the upper hold back clamps 68 and 70 are in an open position. As the pushing mechanism 61 clears the horizontal plane between the lower clamps 69 and 71, the lower clamps are closed or pivoted inward to engage the glass plate stack 47. As the pushing mechanism 61 clears the horizontal plane between the upper hold back clamps 68 and 70, the opposing upper clamps are closed or pivoted inward to engage the top portion of the glass plate stack 47.

At this stage of operation, the vacuum cups 50 of the article transfer mechanism 49 of the placer assembly 48 engage the glass plate 88 and before movement of the vacuum cups 50 the opposing side gates 66 and 67 are pivoted outwardly into an open position to permit the glass plate 88 to be removed from the article release mechanism 52 for transfer into the inverted frames 91 on conveyor 11 at work station 32. Thus, before closure of the pivotable side gates 66 and 67, the glass plate stack 47 is retained or held back by the upper and lower hold back clamps 68 and 70 and 69 and 71, respectively. As the vertical pushing mechanism 61 is moved downwardly, the pivoting side gates 66 and 67 are moved into a closed position and the upper and lower hold back clamps 68 and 70 and 69 and 71 are sequentially opened or moved outwardly. The latter positioning of the elements of the article release mechanism 52 permits the glass plate stack 47 to slide downwardly in the magazine and to again be retained by the pivoting side gates 66 and 67 at the top and by the opposing fixed side clips 96 and 97 at the bottom. Thus, when the vertical pushing mechanism 61 reaches the bottom of its downward movement and the next pair of inverted frames 91 are moved to work station 32, the sequence of operation of the article release mechanism 52 is repeated as described above.

Figure 8:
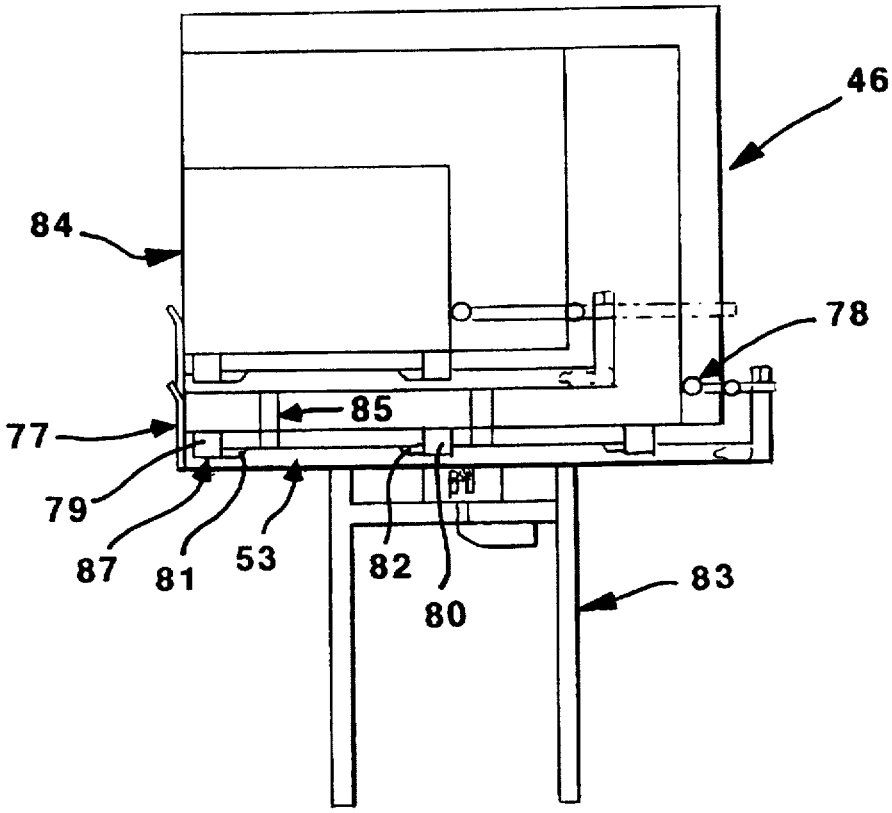
FIG. 8 is a view taken along line 8—8 of FIG. 4.

As shown in FIG. 8, the rear portion of the magazine assembly 46 has removable wear rails 79 and 80 which are positioned in rail channels 87 and secured therein by elongated bars or clamps 81 and 82. Each wear rail has a generally square cross-sectional configuration. The wear rails 79 and 80 engage the bottom surface of the glass plates which are slidingly disposed thereon. Consequently, the rails are constructed and arranged to be worn by this sliding movement. The wear rails may be constructed of a plastic, a nylon or like composition. The wear rails 79 and 80 may be repositioned or turned into slots or channels 87 as the moving glass stack 47 wears a certain rail surface. For example, the wear rails 79 and 80 may be rotated 90 degrees to provide a new sliding surface. Further, as shown in FIG. 4, the magazine deck 53 on which the glass stack 47 slides is disposed at an angle 86 of less than 90°, i.e., 87° with respect to the magazine exit end, to thereby minimize the wear of the glass bottom edges on the surface of rails 79 and 80.

To accommodate the dispensing and release of different sized articles, the magazine assembly 46 is shown to be adjustable. As shown positioned above the magazine deck 53, which is shown supported by structure 83, a riser structure 85 may be utilized to accommodate a smaller magazine 84. A fixed side guide 77 and a movable side guide 78 are provided for such adjustment purposes.

In summary, the glass placing assembly 45 is comprised of an article release mechanism 52 having a vertical pushing mechanism 61, side gate members 66 and 67 and upper and lower hold back clamps 68 and 70 and 69 and 71 which cooperate to move the next-out glass plate 88 from the stack 47 for subsequent transfer by the placer assembly 48. Although the elements of this assembly are shown and described to be pneumatically operated, these elements may also be controlled mechanically, hydraulically or electronically.

As many changes are possible to the embodiments of this invention utilizing the teachings thereof, the descriptions above, and the accompanying drawings should be interpreted in the illustrative and not the limited sense.

That which is claimed:

1. An article placing assembly positioned at the exit end of an article supply magazine structure having a deck for supporting a stack of articles, comprising:

(a) a pushing mechanism constructed and arranged to engage and move successive articles from a stack of articles;

(b) opposing pivoting gate members constructed and arranged to hold and release said articles;

(c) opposing clip members positioned below said pivotable gate members;

(d) at least one pair of movable clamps constructed and arranged to hold said article stack as successive articles are sequentially moved from said article stack; and (e) said exit end of said article supply magazine structure having a bottom end and opposing sides, wherein said pushing mechanism is positioned at said bottom end of said magazine exit end, and wherein said opposing pivoting gate members and said at least one pair of movable clamps are positioned at said opposing sides of said magazine exit end.

2. The article placing assembly of claim 1, wherein said pushing mechanism has a pusher head member and is positioned for movement behind said pivoting gate members.

3. The article placing assembly of claim 1, wherein two pairs of movable clamps are provided, said clamps comprising a pair of upper clamps and a pair of lower clamps.

4. The article placing assembly of claim 1, wherein said pushing mechanism, said opposing pivoting gate members and said at least one pair of movable clamps are synchronized in operation.

5. The article placing assembly of claim 1, wherein said deck structure is positioned at an angle of less than 90 degrees with respect to the exit end of the supply magazine.

6. The article placing assembly of claim 1, wherein said deck of the supply magazine includes aligned wear rail members for supporting said article stack and wherein said wear rails are removably mounted.

7. The article placing assembly of claim 1, wherein said pushing mechanism, said opposing pivoting gate members and said at least one pair of movable clamps are pneumatically operated.

8. A glass placing assembly mounted at the exit end of a supply magazine structure, comprising:

(a) a pushing mechanism constructed and arranged to engage and move an article of glass from a stack of glass articles;

(b) opposing pivoting gate members constructed and arranged to hold and release said article of glass;

(c) opposing clip members positioned below said pivotable gate members;

(d) at least one pair of movable clamps constructed and arranged to hold said stack of glass articles as said articles of glass are sequentially moved from said stack of glass articles; and (e) said exit end of said supply magazine structure being defined by a bottom end and opposing sides, said pushing mechanism being positioned at said bottom end of said magazine exit end, and said opposing pivoting gate members and said at least one pair of movable clamps being positioned at said opposing sides of said magazine exit end.

9. The glass placing assembly of claim 8, wherein said pushing mechanism, said opposing pivoting gate members and said at least one pair of movable clamps are synchronized in operation.

10. The glass placing assembly of claim 8, wherein said magazine structure has aligned rail members for supporting said stack of glass articles and wherein removable wear rails are mounted in said aligned rail members.

11. The glass placing assembly of claim 8, wherein said pushing mechanism has a pusher head member and is positioned for operation behind said pivoting gate members.

12. The glass placing assembly of claim 8, wherein two pairs of movable clamps are provided, said clamps comprising a pair of upper clamps and a pair of lower clamps.

13. The glass placing assembly of claim 8, wherein said magazine structure has a support deck extending from said exit end and wherein said assembly is positioned at an angle of less than 90 degrees with respect to said support deck.

14. A glass placing assembly mounted at the exit end of a supply magazine structure and being constructed and arranged to successively present individual glass articles for pickup by an article transfer mechanism having at least one vacuum cup, comprising:

(a) a pushing mechanism constructed and arranged to engage and move an article of glass from a stack of glass articles, said pushing mechanism being arranged to act from below said exit end and having an upwardly facing abutment surface for engaging and supporting said successive glass articles;

(b) opposing pivoting gate members constructed and arranged to hold and release said article of glass;

(c) at least one pair of movable clamps constructed and arranged to hold said stack of glass articles as said articles of glass are sequentially moved from said stack of glass articles;

(d) opposing stationary clip members positioned below said pivotable gate members;

(e) said assembly being positioned at an angle of less than 90 degrees with respect to said at least one vacuum cup of said article transfer mechanism when in position to pickup and transfer an article of glass; and (f) said magazine structure having aligned rail members for supporting said stack of glass articles and wherein removable wear rails are mounted in said aligned rail members.

15. The glass placing assembly of claim 14 wherein said pushing mechanism has a pusher head member and is positioned for operation behind said pivoting gate members.

16. The glass placing assembly of claim 14 wherein two pairs of moveable clamps are provided, said clamps comprising a pair of upper clamps and a pair of lower clamps.

17. A process for releasably storing a stack of articles in a magazine assembly having an exit end being defined by a bottom end and opposing sides, comprising the steps of:

(a) engaging the bottom of each successive article at the exit end of the magazine assembly and pushing said article upwardly to separate said article from the stack of articles;

(b) restraining the remaining stack of articles from the opposing sides of the magazine assembly exit end;

(c) restraining said separated article in an elevated position by the sides thereof by means of moveable side restraints positioned at the opposing sides of the magazine assembly exit end; and (d) engaging said separated article at its facing surface and removing said separated article while simultaneously removing the side restraints thereof.

18. The process of claim 17, wherein said engaging step is provided by means of a vertically moving pushing mechanism.

19. The process of claim 17, wherein said restraining step of the stack of articles is provided by means of pivotable and opposing side clips.

20. The process of claim 17, wherein said restraining step of the separated article is provided by means of opposing pivotable side gate members.

* * * * *